US007545327B2

(12) United States Patent
Iellici et al.

(10) Patent No.: US 7,545,327 B2
(45) Date of Patent: Jun. 9, 2009

(54) HYBRID ANTENNA USING PARASITIC EXCITATION OF CONDUCTING ANTENNAS BY DIELECTRIC ANTENNAS

(75) Inventors: Devis Iellici, Stow-cum-Quy (GB); Simon Philip Kingsley, Stow-cum-Quy (GB); James William Kingsley, Stow-cum-Quy (GB); Steven Gregory O'Keefe, Chambers Flat (AU); Scott William Spencer Tyler, Stow-cum-Quy (GB)

(73) Assignee: Antenova Ltd., Cambridge (GB)

( * ) Notice: Subject to any disclaimer, the term of this patent is extended or adjusted under 35 U.S.C. 154(b) by 413 days.

(21) Appl. No.: 10/560,739

(22) PCT Filed: Jun. 16, 2004

(86) PCT No.: PCT/GB2004/002497

§ 371 (c)(1),
(2), (4) Date: Dec. 15, 2005

(87) PCT Pub. No.: WO2004/114462

PCT Pub. Date: Dec. 29, 2004

(65) Prior Publication Data

US 2006/0244668 A1 Nov. 2, 2006

(30) Foreign Application Priority Data

Jun. 16, 2003 (GB) ..... 0313890.6

(51) Int. Cl.
*H01Q 1/38* (2006.01)

(52) U.S. Cl. ..... 343/700 MS; 343/702; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 5,434,579 | A | 7/1995 | Kagoshima et al. | |
| 6,426,725 | B2 * | 7/2002 | Hiroshima et al. | 343/741 |
| 6,452,565 | B1 | 9/2002 | Kingsley et al. | |
| 6,879,287 | B2 * | 4/2005 | Popov et al. | 343/700 MS |
| 7,253,789 | B2 * | 8/2007 | Kingsley et al. | 343/911 R |
| 2002/0180646 | A1 * | 12/2002 | Kivekas et al. | 343/700 MS |

(Continued)

FOREIGN PATENT DOCUMENTS

| | | |
|---|---|---|
| EP | 1018778 | 7/2000 |

(Continued)

OTHER PUBLICATIONS

Kingsley, S.P. and O'Keefe, S.G., "Beam steering and monopulse processing of probe-fed dielectric resonator antennas", IEE Proceedings—Radar Sonar and Navigation, 146, 3, 121-125, 1999.

(Continued)

*Primary Examiner*—HoangAnh T Le
(74) *Attorney, Agent, or Firm*—Pearl Cohen Zedek Latzer, LLP

(57) ABSTRACT

An integrated antenna device comprising a first, dielectric antenna component (1) and a second, electrically-conductive antenna component (9), wherein the first and second components are not electrically connected to each other but are mutually arranged such that the second component is parasitically driven by the first component when the first component is fed with a predetermined signal.

6 Claims, 4 Drawing Sheets

U.S. PATENT DOCUMENTS

2003/0043075 A1 3/2003 Zaridze et al.

FOREIGN PATENT DOCUMENTS

| | | |
|---|---|---|
| EP | A-1 128 466 | 8/2001 |
| EP | A-1 271 691 | 1/2003 |
| FR | A-2 829 300 | 3/2003 |
| WO | WO97/41681 | 11/1997 |
| WO | WO 03/019718 | 3/2003 |
| WO | WO 2004/017461 | 2/2004 |

OTHER PUBLICATIONS

Long, S.A., McAllister, M.W., and Shen, L.C.: "The Resonant Cylindrical Dielectric Cavity Antenna", IEEE Transactions on Antennas and Propagation, AP-31, 1983, pp. 406-412.

Mongia, R.K. and Bhartia, P.: "Dielectric Resonator Antennas—A Review and General Design Relations for Resonant Frequency and Bandwidth", International Journal of Microwave and Millimetre-Wave Computer-Aided Engineering, 1994, 4, (3), pp. 230-247.

Petosa, A., Ittipiboon, A., Antar, Y.M.M., Roscoe, D., and Cuhaci, M.: "Recent advances in Dielectric-Resonator Antenna Technology", IEEE Antennas and Propagation Magazine, 1998, 40, (3), pp. 35-48.

McAllister, M.W., Long, S.A. and Conway G.L.: "Rectangular Dielectric Resonator Antenna", Electronics Letters, 1983, 19, (6), pp. 218-219.

Ittipiboon, A., Mongia, R.K., Antar, Y.M.M., Bhartia, P. and Cuhaci, M.: "Aperture Fed Rectangular and Triangular Dielectric Resonators for use as Magnetic Dipole Antennas", Electronics Letters, 1993, 29, (23), pp. 2001-2002.

K.W.: "Simple results for conformal-strip excited hemispherical dielectric resonator antenna", Electronics Letters, 2000, 36, (11).

Long, S.A., McAllister, M.W., and Shen, L.C.: "The Resonant Cylindrical Dielectric Cavity Antenna", IEEE Transactions on Antennas and Propagation, AP-31, 1983, pp. 406-412.

Mongia, R.K., Ittipiboon, A., Antar, Y.M.M., Bhartia, P. and Cuhaci, M: "A Half-Split Cylindrical Dielectric Resonator Antenna Using Slot-Coupling", IEEE Microwave and guided Wave Letters, 1993, vol. 3, No. 2, pp. 38-39.

Tam, M.T.K. and Murch, R.D.: "Half volume dielectric resonator antenna designs", Electronics Letters, 1997, 33, (23), pp. 1914-1916.

Simons, R.; Lee, R.; "Effect of parasitic dielectric resonators on CPW/aperture-coupled dielectric resonator antennas", *IEE proceedings-H*, 140, pp. 336-338, 1993.

Cheng-Shong Hong—"Adjustable Frequency Dielectric Resonator Antenna" Proc Nutl. Sci. Counc ROC(A) vol. 23, No. 6, 1999 pp. 736-738.

L Ranth—"Broadband, Low-profile Antenna for Portable Data Terminal" Dept. of Electrical and Coomputer Engineering University of Wisconsin-Madison, 1997.

R. T Long "Use of parasitic strip to provide circular polarization and increased bandwidth for cylindrical dielectric resonator antenna"—Electronic Letters 29$^{th}$ Mar. 2001 vol. 37 No. 7.

Search Report—Oct. 31, 2003—Application No. GB 031.3890.6.

Zhi Ning Chen, Kazuhiro Hirasawa "A New Inverted F Antenna with a Ring Dielectric Resonator". IEEE Transactions on Vehicular Technology. vol. 48. No. 4 Jul. 1999.

International Search Report—Sep. 2, 2004 —Application No. GB 2004/022497.

* cited by examiner

HYBRID ANTENNA USING PARASITIC EXCITATION OF CONDUCTING ANTENNAS BY DIELECTRIC ANTENNAS

CROSS-REFERENCE TO RELATED APPLICATIONS

This application is a National Phase Application of PCT International Application No. PCT/GB2004/002497, International Filing Date Jun. 16, 2004, claiming priority of Great Britain Patent Application 0313890.6, filed Jun. 16, 2003, which are both incorporated by reference herein in their entirety.

FIELD OF THE INVENTION

The present invention relates to multi-band antenna structures and techniques for the construction thereof, by using dielectric antennas to excite other non-dielectric electrical parasitic structures. The dielectric antennas include, but are not limited to, dielectric resonator antennas (DRAs), high dielectric antennas (HDAs) and dielectrically loaded antennas (DLAs).

BACKGROUND OF THE INVENTION

Dielectric resonator antennas are resonant antenna devices that radiate or receive radio waves at a chosen frequency of transmission and reception, as used in for example in mobile telecommunications. In general, a DRA consists of a volume of a dielectric material (the dielectric resonator) disposed on or close to a grounded substrate, with energy being transferred to and from the dielectric material by way of monopole probes inserted into the dielectric material or by way of monopole aperture feeds provided in the grounded substrate (an aperture feed is a discontinuity, generally rectangular in shape, although oval, oblong, trapezoidal or butterfly/bow tie shapes and combinations of these shapes may also be appropriate, provided in the grounded substrate where this is covered by the dielectric material. The aperture feed may be excited by a strip feed in the form of a microstrip transmission line, coplanar waveguide, slotline or the like which is located on a side of the grounded substrate remote from the dielectric material). Direct connection to and excitation by a microstrip transmission line is also possible. Alternatively, dipole probes may be inserted into the dielectric material, in which case a grounded substrate is not required. By providing multiple feeds and exciting these sequentially or in various combinations, a continuously or incrementally steerable beam or beams may be formed, as discussed for example in the present applicant's co-pending U.S. patent application Ser. No. 09/431,548 and the publication by KINGSLEY, S. P. and O'KEEFE, S. G., "Beam steering and monopulse processing of probe-fed dielectric resonator antennas", IEE Proceedings—Radar Sonar and Navigation, 146, 3, 121-125, 1999, the full contents of which are hereby incorporated into the present application by reference.

The resonant characteristics of a DRA depend, inter alia, upon the shape and size of the volume of dielectric material and also on the shape, size and position of the feeds thereto. It is to be appreciated that in a DRA, it is the dielectric material that resonates when excited by the feed. This is to be contrasted with a dielectrically loaded antenna (DLA), in which a traditional conductive radiating element is encased in a dielectric material that modifies the resonance characteristics of the radiating element. As a further distinction, a DLA has either no, or only a small, displacement current flowing in the dielectric whereas a DRA or HDA has a non-trivial displacement current.

Dielectric resonators may take various forms, a common form having a cylindrical shape or half- or quarter-split cylindrical shape. The resonator medium can be made from several candidate materials including ceramic dielectrics.

Since the first systematic study of dielectric resonator antennas (DRAs) in 1983 [LONG, S. A., McALLISTER, M. W., and SHEN, L. C.: "The Resonant Cylindrical Dielectric Cavity Antenna", IEEE Transactions on Antennas and Propagation, AP-31, 1983, pp 406-412], interest has grown in their radiation patterns because of their high radiation efficiency, good match to most commonly used transmission lines and small physical size [MONGIA, R. K. and BHARTIA, P.: "Dielectric Resonator Antennas—A Review and General Design Relations for Resonant Frequency and Bandwidth", International Journal of Microwave and Millimetre-Wave Computer-Aided Engineering, 1994, 4, (3), pp 230-247]. A summary of some more recent developments can be found in PETOSA, A., ITTIPIBOON, A., ANTAR, Y. M. M., ROSCOE, D., and CUHACI M.: "Recent advances in Dielectric-Resonator Antenna Technology", IEEE Antennas and Propagation Magazine, 1998, 40, (3), pp 35-48.

A variety of basic shapes have been found to act as good dielectric resonator structures when mounted on or close to a ground plane (grounded substrate) and excited by an appropriate method. Perhaps the best known of these geometries are:

Rectangle [McALLISTER, M. W., LONG, S. A. and CONWAY G. L.: "Rectangular Dielectric Resonator Antenna", Electronics Letters, 1983, 19, (6), pp 218-219].

Triangle [ITTIPIBOON, A., MONGIA, R. K. ANTAR, Y. M. M., BHARTIA, P. and CUHACI, M.: "Aperture Fed Rectangular and Triangular Dielectric Resonators for use as Magnetic Dipole Antennas", Electronics Letters, 1993, 29, (23), pp 2001-2002].

Hemisphere [LEUNG, K. W.: "Simple results for conformal-strip excited hemispherical dielectric resonator antenna", Electronics Letters, 2000, 36, (11)]

Cylinder [LONG, S. A., McALLISTER, M. W., and SHEN, L. C.: "The Resonant Cylindrical Dielectric Cavity Antenna", IEEE Transactions on Antennas and Propagation, AP-31, 1983, pp 406-412].

Half-split cylinder (half a cylinder mounted vertically on a ground plane) [MONGIA, R. K., ITTIPIBOON, A., ANTAR, Y. M. M., BHARTIA, P. and CUHACI, M: "A Half-Split Cylindrical Dielectric Resonator Antenna Using Slot-Coupling", IEEE Microwave and guided Wave Letters, 1993, Vol. 3, No. 2, pp 38-39].

Some of these antenna designs have also been divided into sectors. For example, a cylindrical DRA can be halved [TAM, M. T. K. and MURCH, R. D.: "Half volume dielectric resonator antenna designs", Electronics Letters, 1997, 33, (23), pp 1914-1916]. However, dividing an antenna in half, or sectoring it further, does not change the basic geometry from cylindrical, rectangular, etc.

High dielectric antennas (HDAs) are similar to DRAS, but instead of having a full ground plane located under the dielectric resonator, HDAs have a smaller ground plane or no ground plane at all. DRAs generally have a deep, well-defined resonant frequency, whereas HDAs tend to have a less well-defined response, but operate over a wider range of frequencies.

In both DRAs and HDAs, the primary radiator is the dielectric resonator. In DLAs the primary radiator is a conductive component (e.g. a copper wire or the like) and the dielectric modifies the medium in which the antenna operates, and generally makes the antenna smaller. A simple way to make a printed monopole antenna is to extend a microstrip into a region where there is no grounded substrate on the other side of the board.

It is known that one dielectric resonator antenna can excite another one parasitically. Indeed, the effects of parasitic dielectric resonator antennas on a cylindrical dielectric resonator antenna were studied as early as 1993 [Simons, R.; Lee, R.; "Effect of parasitic dielectric resonators on CPW/aperture-coupled dielectric resonator antennas", *IEE proceedings-H*, 140, pp. 336-338, 1993]. A similar study for a parasitic three-element array of rectangular dielectric resonator antennas was reported in 1996 [Fan, Z.; Antar, Y.; Ittipiboon, A.; Petosa, A.; W "Parasitic coplanar three element dielectric resonator antenna subarray", *Electronics Letters,* 32, pp. 789-790, 1996].

It is also known that a dielectric resonator antenna with one probe feed can have another feed excited parasitically, i.e. the second feed is not driven by the electronic circuitry [Long, R.; Dorris, R.; Long, S.; Khayat, M.; Williams, J.; "Use of Parasitic Strip to produce circular polarisation and increased Bandwidth for cylindrical Dielectric Resonator Antenna", *Electronics Letters,* 37, pp. 406-408, 2001].

Proc. Natl. Sci. Counc. ROC(A), Vol 23, No 6, 1999, pp 736-738, C.-S. Hong, "Adjustable frequency dielectric resonator antenna" discloses a DRA directly fed by a microstrip transmission line, and further provided with a conductive parasitic disc element adjustably mounted over a top surface of the DRA. The disc element is moved closer to or further away from the top surface of the DRA so as to tune the DRA to predetermined frequencies. It is to be noted that the parasitic disc element is not configured so as to act as a useful radiating antenna component in its own right, but merely to tune the DRA.

EEE Transactions on Vehicular Technology, Vol 48, No 4, July 1999, pp 1029-1032, Z. N. Chen et al., "A new inverted F antenna with a ring dielectric resonator" discloses a wire IFA (WIFA) with a first, driven leg, a second, parasitic leg and a third, horizontal element connected to both legs. The horizontal element is formed as a probe in dielectric disc, causing the disc to act as a DRA. The conducting antenna component (the WIFA) is driven, with one part of the WIFA in turn driving a DRA. Although the WIFA has a parasitic leg, this is not parasitically driven by the DRA per se.

EP 1 271 691 (Filtronic) discloses a DRA having a direct feedline 231 that, in addition to driving the DRA, serves itself as a radiator in the same frequency range as the DRA. FIG. 2 shows one embodiment in which the dielectric pellet 220 rests on a groundplane 210, and in which two sides 221, 222 of the pellet are metallised. The feedline 231 contacts the top surface 223 of the pellet 220 and thus drives the pellet 220, while also being configured to radiate in the same frequency range as the pellet 220. The DRA does not parasitically drive any further antenna components. An alternative embodiment is shown in FIGS. 5*a* and 5*b*, where a direct feedline 531 is disposed between the bottom of the pellet 520 and the groundplane 510. An additional parasitic element 532 is disposed under the pellet, but this is not parasitically driven by the DRA, but merely serves to broadband the direct feedline 531. In other words, the parasitic element 532 is excited by the direct feedline 531 and not by the DRA.

WO 03/019718 (CNRS et al.) discloses a stripline-fed DRA mounted on a groundplane, with a "parasitic element" 50 located on top of the pellet so as to create an asymmetry. The parasitic element 50 is not in itself configured or designed to radiate in a useful manner.

Electronic Letters, Vol 37, No 7, March 2001, pp 406-408, R. T. Long et al., "Use of a parasitic strip to produce circular polarisation and increased bandwidth for cylindrical dielectric resonator antennas" discloses an arrangement in which one or more parasitic strips are provided on side surfaces of a cylindrical DRA so as to improve bandwidth and to produce circular polarisation. Again, the parasitic strips are configured solely to modify resonant characteristics of the DRA, and are not designed to radiate themselves in a useful manner.

There appear to be no reports in the literature, however, of dielectric antennas being used to excite conventional antennas such as patches, PILAs (planar inverted-L antennas), dipoles, slot antennas, etc. in such a way that both the dielectric antenna and the conventional parasitic antenna radiate at useful frequencies and in a manner that is mutually compatible, for example with a view to providing a hybrid antenna with broadband or multiband operation.

SUMMARY OF THE INVENTION

According to the present invention, there is provided an integrated antenna device comprising a first, dielectric antenna component and a second, electrically-conductive antenna component, wherein the first and second components are not electrically connected to each other but are mutually arranged such that the second component is parasitically driven by the first component when the first component is fed with a predetermined signal.

BRIEF DESCRIPTION OF THE DRAWINGS

For a better understanding of the present invention and to show how it may be carried into effect, reference shall now be made by way of example to the accompanying drawings, in which.

DETAILED DESCRIPTION OF THE INVENTION

Figure 1:
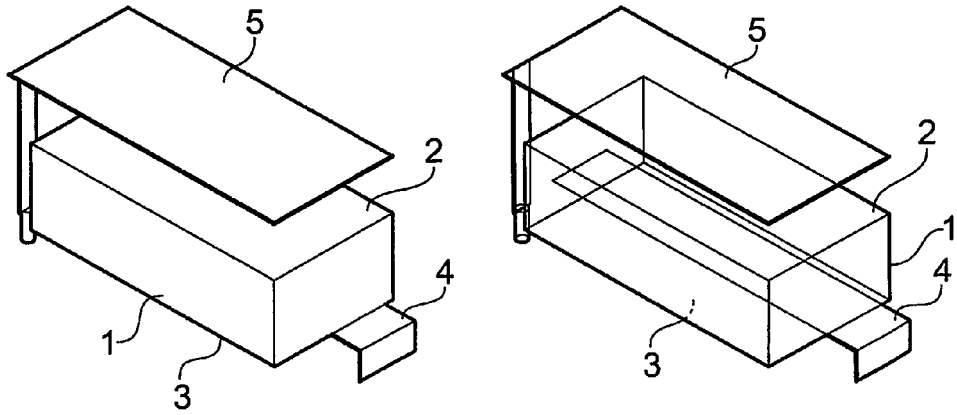
FIG. 1 shows a driven dielectric antenna provided with a parasitic PILA.

For the avoidance of doubt, the expression "electrically-conductive antenna components" defines a traditional antenna component such as a patch antenna, slot antenna, monopole antenna, dipole antenna, planar inverted-L antenna (PILA) or any other antenna component that is not a DRA, HDA or DLA. Furthermore, these antenna components are specifically designed to radiate at a predetermined frequency or frequencies in a manner useful for telecommunications applications. The expression "antenna components" does not include parasitic patches or the like that simply modify the resonance characteristics of the dielectric antenna, but only actual antenna components that are configured to radiate in a useful and predetermined manner.

Additionally, for the purposes of the present application, the expression "dielectric antenna" is hereby defined as encompassing DRAs, HDAs and DLAs, although in some embodiments DRAs are specifically excluded.

Embodiments of the present invention thus relate to the use of DRAs, HDAs and DLAs as primary radiating structures to excite parasitically more conventional conducting antennas which serve as secondary radiating structures. Furthermore, embodiments of the present invention relate to the use of a DRA, HDA or DLA as a primary radiating structure comprised as a piece or pellet of high dielectric constant ceramic material excited by some form of feed structure on a printed circuit board (PCB) substrate or the like. The secondary, parasitic radiating structure has no feed and is driven by mutual coupling with the DRA, HDA or DLA and may be of a more conventional design made from copper or other conducting materials.

Advantageously, the first and second components are configured to radiate at different frequencies, thus providing at least a dual band integrated antenna device, and in some embodiments a four band integrated antenna device.

The first, driven antenna component may advantageously be configured as a dielectric antenna comprising a dielectric pellet mounted on a first side of a dielectric substrate, a microstrip feed located on the first side of the substrate and extending between the substrate and the dielectric pellet or contacting a side wall thereof, and a conductive layer formed on a second side of the substrate opposed to the first, wherein an aperture is formed in the conductive layer or the conductive layer is removed from the second side of the substrate at a location corresponding to that of the dielectric pellet.

Alternatively, the first, driven antenna component may be configured as a dielectric antenna comprising a microstrip feed located on a first side of a dielectric substrate, a conductive layer formed on a second side of the substrate opposed to the first and having an aperture formed therein, wherein a dielectric pellet is mounted on a second side of the substrate within or at least overlapping the aperture.

In these embodiments, the driven antenna component is an HDA.

The dielectric substrate may be a printed circuit board (PCB) substrate.

Dielectric antennas of these types are more fully described in the present applicant's copending International patent application WO 2004/017461 of 14$^{th}$ Aug. 2003, the full disclosure of which is hereby incorporated into the present application by reference.

The second, parasitic antenna component may be located adjacent the first, driven antenna component on the dielectric substrate, or may extend over a top surface of the first antenna component.

The second, parasitic antenna component may be dielectrically loaded, for example with a pellet of low $E_r$ dielectric material.

In a particularly preferred embodiment, the first antenna component comprises a dielectric antenna as defined in the preceding paragraphs, and the second antenna component comprises a parasitic non-dielectric PILA configured to radiate at a higher or lower frequency than the first antenna component.

Integrated antenna devices of the present invention are particularly suited to mobile telephony and data terminal (e.g. WLAN or Bluetooth®) applications.

The first antenna component is preferably configured to radiate such that it covers a high band frequency range (e.g. 1710 to 2170 MHz).

The second antenna component is preferably configured to radiate such that it covers a low band frequency range or ranges (e.g. 824 to 960 MHz).

It will be appreciated, however, that the first antenna component may cover a low band frequency range and the second antenna component may cover a high band frequency range. In this way, the smaller size of the second parasitic antenna component may allow the use of more than one with each dielectric antenna component, thereby allowing more bands to be covered by the parasitic antenna components.

In some embodiments, a sidewall of the dielectric pellet (e.g. a surface of the pellet generally perpendicular to the plane of the dielectric substrate) may be metallised (e.g. by coating with a metal paint or the like).

In embodiments specifically using a DRA as the first antenna component (i.e. with a conductive groundplane under the pellet), the dielectric pellet will generally need to be formed in a predetermined shape or configuration so as to resonate in a desired mode and/or at a desired frequency. The relationship between shape and configuration of a dielectric pellet and its resonance response in a DRA are well-known to those of ordinary skill in the art.

In embodiments specifically using an HDA as the first antenna component (i.e. with no or only some conductive groundplane under the pellet), almost any shape of pellet may be used, since the frequency response is much less well defined.

An alternative to the parasitic arrangement discussed above is to have two feed networks, one driving a PIFA (planar inverted-F antenna), for example, and the other driving the dielectric antenna A feed combination can then be used to provide a single feed point for the antenna arrangement. However, feed combining is a lossy process and involves microstrip tracks occupying a significant additional board area.

FIG. 1 shows a general example of an oblong dielectric ceramics pellet 1 with an upper surface 2 and a lower surface 3, the lower surface 3 being contacted by a direct microstrip feedline 4, which may be made of copper or the like. A PILA 5, which is made of an electrically-conductive material (e.g. copper), is arranged so as to pass over the upper surface 2 of the pellet 1. The PILA 5 is not electrically connected to the pellet 1 or the feedline 4, but instead is excited parasitically when the pellet 1 is caused to radiate when fed with a signal by the feedline 4. The PILA 4 radiates at a different frequency to the pellet 1, and thus a dual band hybrid antenna is formed.

Figure 2:
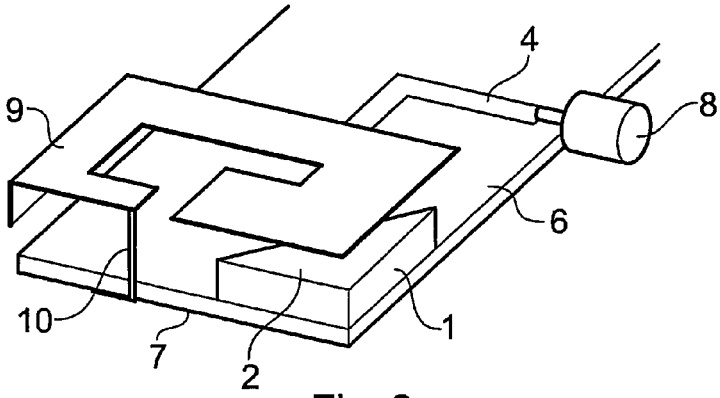
FIG. 2 shows a broadband dielectric antenna mounted in a corner of a PCB with a parasitic PILA passing over a top of the dielectric antenna.

FIG. 2 shows a first particularly preferred embodiment of the present invention comprising a triangular dielectrics ceramic pellet 1 mounted in a corner of a PCB substrate 6. The PCB substrate 6 may be a PCB of a mobile telephone handset (not shown), and may be provided with a conductive groundplane 7 on a surface opposed to that on which the pellet 1 is mounted. The pellet 1 is excited by a direct microstrip feedline 4 that is formed on the surface of the substrate 6 and contacts the pellet 1, either on a side surface thereof or an underside thereof. A connector 8 is provided for connecting the feedline 4 to a signal source. The dielectric antenna component of this embodiment may be a broadband dielectric antenna (e.g. an HDA). A PILA 9 is also provided, the PILA 9 being supported by a shorting bar 10 which electrically connects the PILA 9 to the groundplane 7 and holds the PILA 9 in position over the top surface 2 of the pellet 1. It is to be noted that the PILA 9 is shaped and configured so as to make maximum use of a width of the PCB substrate 6.

The hybrid antenna of FIG. 2 may be configured as a four-band handset antenna by using a broadband high dielectric antenna in the corner of the PCB substrate 6 to radiate over the 1800 GSM, 1900 GSM and WCDMA bands (1710-2170 MHz). The PILA 9 may be configured as a 900 MHz GSM band (880-960 MHz) PILA that passes over the top of the pellet 1 and is parasitically excited thereby.

Figure 3:
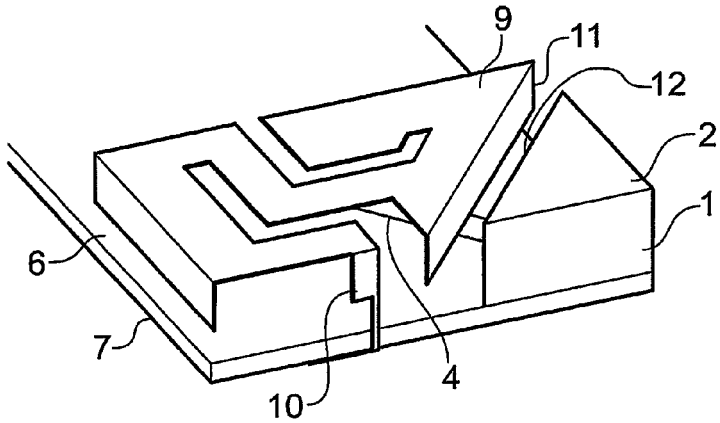
FIG. 3 shows a dielectric antenna mounted in a corner of a PCB with a parasitic PILA adjacent thereto but not passing over the dielectric antenna.

FIG. 3 shows a second particularly preferred embodiment of the present invention, similar to that of FIG. 2, but distinguished in that the PILA 9 does not pass over the top of the pellet 1, but stops short thereof. An optional capacitive loading flap 11 may provided by folding down an edge portion of the PILA 9 parallel to a diagonal edge 12 of the pellet 1. The flap 11, where provided, helps to lower a frequency of operation of the PILA 9 and to compensate for the smaller area of the substrate 6 that is used. The configuration of the second preferred embodiment allows the PILA 9 may be mounted closer to the PCB substrate 6 and thereby helps to provide an antenna with a lower overall height (measured perpendicular to the substrate 6).

The hybrid antenna of FIG. 3 may also be configured as a four-band handset antenna by using a broadband HDA to cover the wideband, as in the first preferred embodiment, and to excite a 900 MHz GSM band PILA 9 that does not pass over the top surface 2 of the pellet 1.

Figure 4:
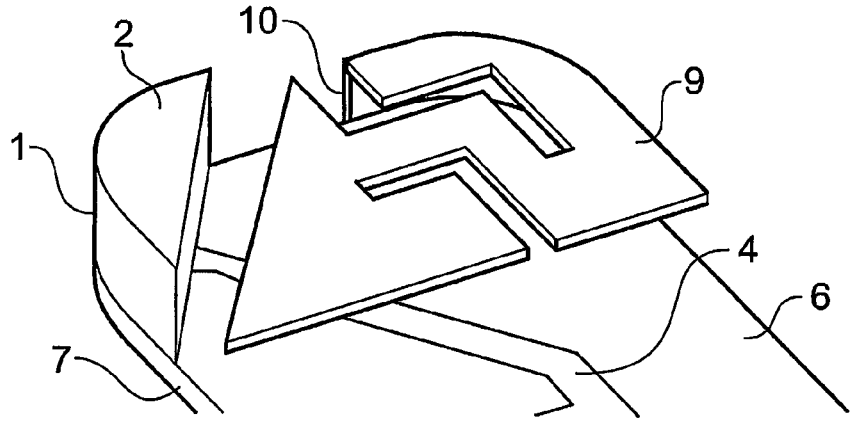
FIG. 4 shows a practical hybrid antenna design shaped to fit inside a modem mobile telephone handset casing.

FIG. 4 shows a third preferred embodiment of the present invention corresponding generally to that of FIG. 3, but with a corner portion of the pellet 1, a corner portion of the PILA 9 and corner portions of the substrate 6 provided with a curved shape so as to conform to a shape of a modern mobile telephone handset casing (not shown). In addition, the PILA 9 is shown without a capacitive loading flap 11.

Figure 5:
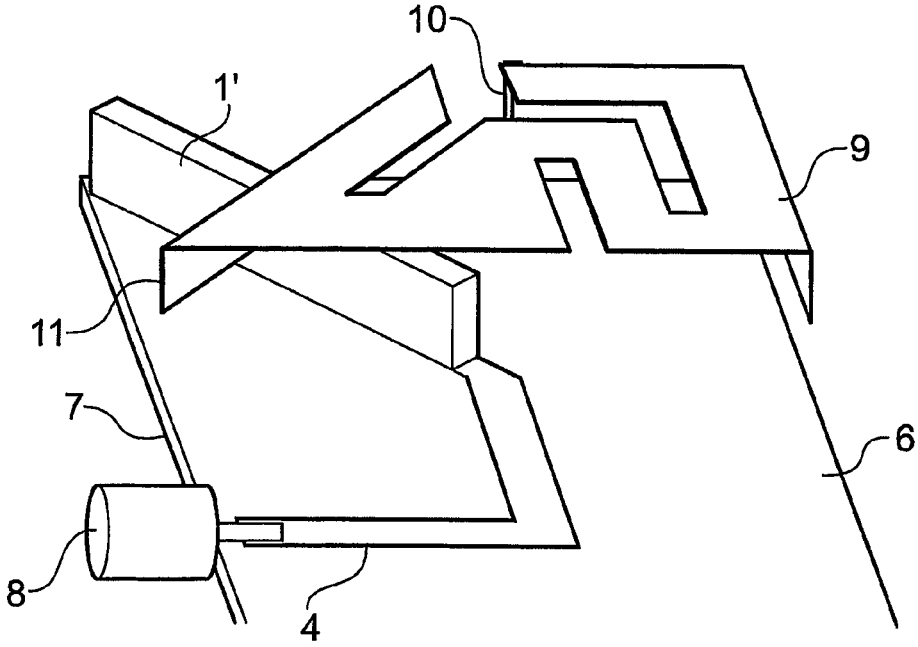
FIG. 5 shows an oblong dielectric antenna mounted on a PCB with a parasitic PILA passing thereover.

FIG. 5 shows a fourth preferred embodiment of the present invention comprising an oblong dielectric pellet 1' mounted diagonally on the PCB substrate 6 and extending from a central part thereof into a corner thereof. A conductive groundplane 7 is provided on a surface of the substrate 6 opposed to that on which the pellet 1 is located. A PILA 9 of the type shown in FIG. 3 is provided and passes over the pellet 1'. This embodiment uses less ceramic dielectric material in the pellet 1' than the embodiments of FIGS. 2 to 4, and therefore weighs less.

Figure 6A:
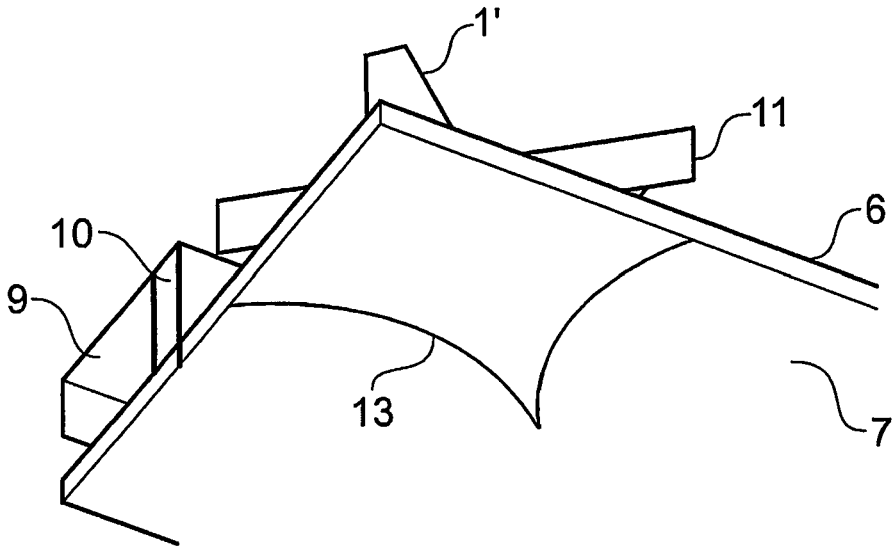
FIGS. 6(*a*) and 6(*b*) show an underside of the PCB of FIG. 5 with part of a groundplane removed from a corner portion thereof.
Figure 6B:
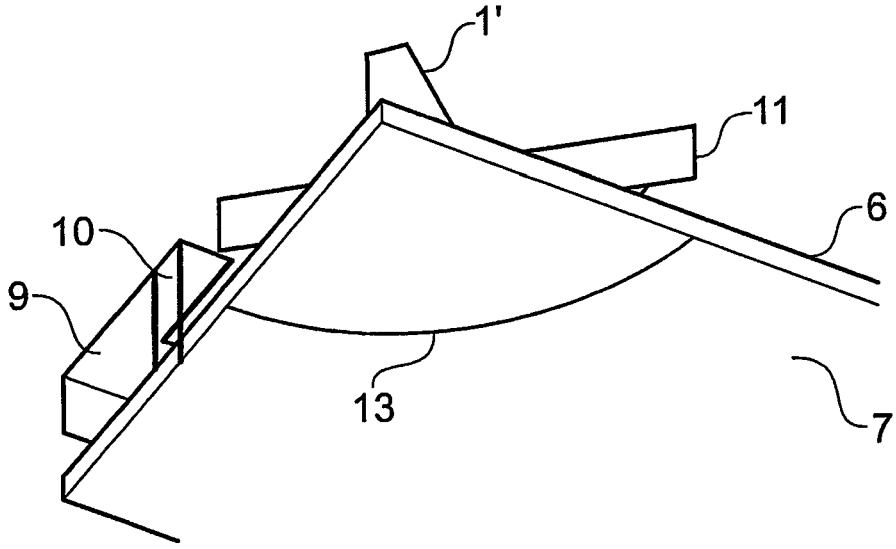

FIGS. 6(*a*) and 6(*b*) show alternative configurations of the embodiment of FIG. 5 from underneath the PCB substrate 6. In FIGS. 6(*a*) and 6(*b*), a portion 13 of the groundplane 7 has been removed in a region corresponding generally to a location of the pellet 1' on the other side of the substrate 6. The removed portion 13 of the groundplane 7 may have a pointed or curved shape as shown, or may be removed along a diagonal or have any other appropriate shape. By removing an area 13 of the groundplane 7 under the pellet 1', the bandwidth can be adjusted to as to suit the number of bands that are to be serviced by the antenna. The efficiency of the antenna may also be adjusted in this manner.

Figure 7:
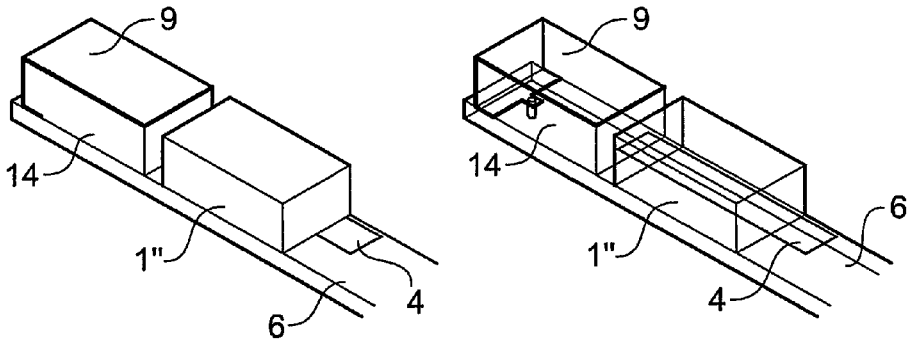
FIG. 7 shows a dual band WLAN antenna comprising a driven dielectric antenna and a parasitic PILA mounted adjacent thereto.
Figure 8:
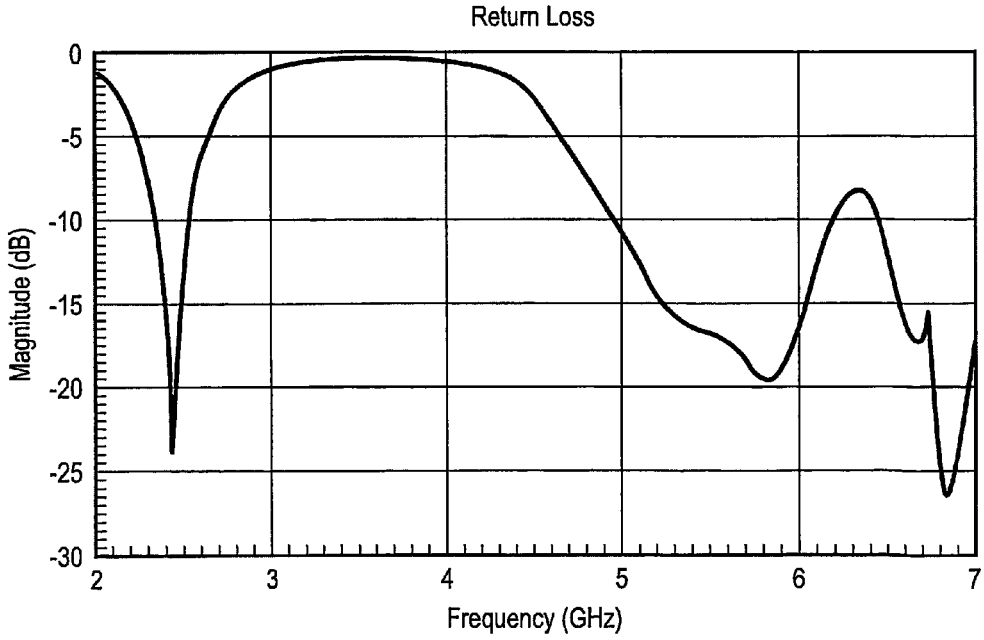
FIG. 8 shows an $S_{11}$ return loss plot of the antenna of FIG. 7.

FIG. 7 shows a fifth preferred embodiment of the present invention comprising a dual band Wireless LAN antenna designed to operate in the Bluetooth/WLAN802.11b band (2.4-2.5 GHz) and the WLAN802.11a bands (4.9-5.9 GHz). The WLAN antenna consists of a driven dielectric antenna comprising an oblong high $E_r$ dielectric ceramics pellet 1" mounted on a direct microstrip feedline 4 printed on one side of a PCB substrate 6. A parasitic PILA 9 is provided adjacent the pellet 1", the PILA 9 being further provided with a low $E_r$ dielectric loading pellet 14 which also contacts the feedline 4. The dielectric pellet 1" radiates in the upper band and the PILA 9 radiates in the lower band. The combination results in a device having a single feed point but with the dual band performance shown in the $S_{11}$ return loss plot of FIG. 8.

In alternative preferred embodiments (not shown), there may be provided a hybrid antenna as generally as described above in relation to FIGS. 1 to 8, but in which the driven dielectric antenna component radiates at a lower frequency and the parasitic element radiates at a higher frequency. The smaller size of the higher frequency parasitic antenna component may allow the use of more than one parasitic antenna component and thus may achieve coverage of further bands.

The preferred features of the invention are applicable to all aspects of the invention and may be used in any possible combination.

Throughout the description and claims of this specification, the words "comprise" and "contain" and variations of the words, for example "comprising" and "comprises", mean "including but not limited to", and are not intended to (and do not) exclude other components, integers, moieties, additives or steps.

The invention claimed is:

1. An integrated antenna device comprising a first. dielectric antenna and a second, electrically-conductive antenna, wherein the first and second antennas are not electrically connected to each other but are mutually arranged such that the second antenna is parasitically driven by the first antenna when the first antenna is fed with a predetermined signal wherein the second antenna is connected to ground, and wherein the first and second antennas are configured to radiate in different freouency bands;

wherein the first antenna comprises a high dielectric antenna formed as a dielectric pellet mounted on the first side of a dielectric substrate, a microstrip feed located on the first side of the dielectric substrate and extending between the substrate and the dielectric pellet, and a conductive layer formed on a second side of the dielectric substrate opposed to the first side of the dielectric substrate; and wherein an aperture is formed in the conductive layer or the conductive layer is removed from the second side of the dielectric substrate at a location corresponding to that of the dielectric pellet.

2. A device as claimed in claim 1, wherein the second antenna is a patch antenna, slot antenna, monopole antenna, dipole antenna or planar inverted-L antenna.

3. A device as claimed in claim 1, wherein the second antenna is located adjacent the first antenna.

4. A device as claimed in claim 1, wherein the second antenna extends over a top surface of the first antenna.

5. A device as claimed in claim 1 wherein the first antenna is adapted to radiate at a frequency lower than the second antenna.

6. A device as claimed in claim 1 wherein the first antenna is adapted to radiate at a frequency higher than the second antenna.

* * * * *